US008939327B2

(12) United States Patent
Faneca Llesera

(10) Patent No.: US 8,939,327 B2
(45) Date of Patent: Jan. 27, 2015

(54) PUMP AND BOTTLE FITMENTS AND METHODS FOR USING THE SAME

(75) Inventor: Oscar Faneca Llesera, Barcelona (ES)

(73) Assignee: MeadWestvaco Calmar, Inc., Richmond, VA (US)

( * ) Notice: Subject to any disclaimer, the term of this patent is extended or adjusted under 35 U.S.C. 154(b) by 111 days.

(21) Appl. No.: 13/635,062

(22) PCT Filed: Mar. 17, 2011

(86) PCT No.: PCT/US2011/028833

§ 371 (c)(1),
(2), (4) Date: Sep. 14, 2012

(87) PCT Pub. No.: WO2011/116201

PCT Pub. Date: Sep. 22, 2011

(65) Prior Publication Data

US 2013/0001257 A1 Jan. 3, 2013

(51) Int. Cl.
*B65D 41/17* (2006.01)
*B05B 11/00* (2006.01)

(52) U.S. Cl.
CPC ..... *B05B 11/001* (2013.01); *B05B 11/3049* (2013.01)
USPC ..... 222/321.7; 222/321.8; 215/274; 215/318

(58) Field of Classification Search
CPC ..... B05B 11/3001; B05B 11/3047
USPC ..... 222/153.09, 321.7–321.9, 385, 153.11; 215/272, 274, 280, 318
See application file for complete search history.

(56) References Cited

U.S. PATENT DOCUMENTS

| | | | | |
|---|---|---|---|---|
| 4,366,921 | A * | 1/1983 | Kirk, Jr. | 222/153.09 |
| 6,315,169 | B1 * | 11/2001 | de Rosa | 222/321.7 |
| 6,367,641 | B1 | 4/2002 | Garcia et al. | |
| 6,409,049 | B1 * | 6/2002 | de Pous et al. | 222/153.09 |
| 6,923,343 | B1 * | 8/2005 | Erxleben | 222/153.09 |
| 7,207,452 | B2 * | 4/2007 | Jourdin | 215/274 |
| 7,784,645 | B2 * | 8/2010 | Carta | 222/153.01 |
| 8,061,542 | B2 * | 11/2011 | Poupore et al. | 215/44 |
| 8,408,422 | B2 * | 4/2013 | Leleu | 222/153.09 |
| 2005/0061834 | A1 * | 3/2005 | Garcia et al. | 222/321.7 |
| 2009/0283549 | A1 * | 11/2009 | Beranger | 222/321.7 |

FOREIGN PATENT DOCUMENTS

| | | |
|---|---|---|
| FR | 2932783 | 12/2009 |
| WO | WO 2009/143148 | 11/2009 |

OTHER PUBLICATIONS

International Search Report for PCT/US2011/028833, Sep. 18, 2012.

* cited by examiner

*Primary Examiner* — Kevin P Shaver
*Assistant Examiner* — Robert Nichols, II
(74) *Attorney, Agent, or Firm* — MeadWestvaco Intellectual Property Group

(57) ABSTRACT

A pump and container connector fitment system (210) for retaining a pump (200) on a container (120) and allowing the pump to be removed through rotational forces from the container.

10 Claims, 16 Drawing Sheets

PUMP AND BOTTLE FITMENTS AND METHODS FOR USING THE SAME

CROSS-REFERENCE TO RELATED APPLICATIONS

This application claims the benefit of U.S. Provisional Application No. 61/315,128, entitled "PUMP AND BOTTLE FITMENTS AND METHODS FOR USING THE SAME," filed Mar. 18, 2010, and incorporates the same herein by reference in its entirety.

BACKGROUND OF THE INVENTION

1. Field of the Invention

The invention relates to removable pumps and more particularly to fastening systems and devices for attaching a pump to a bottle or container and allowing the pump to be removed from the bottle or container.

2. State of the Art

Pump and container systems are well known. Pumps may be connected to containers in many different ways. For example, pumps may be screwed onto a container, fit to a container with a bayonet-type attachment, or permanently fixed to the container such as by a crimping method.

Fragrance pumps are often crimped to a container to prevent removal of the pump from the container. Other systems, whereby a clip system or pressure fitment system is used to connect a pump to a container, are also used. Examples of various pump and bottle fitment systems are illustrated in the following: U.S. Pat. No. 5,697,530; U.S. Pat. No. 6,619,495; and United States Patent Application Publication 2006/0151541, each of which are incorporated herein by reference in their entireties. Some of the advantages of a crimp system or pressure-type pump fitment system include the speed at which the pumps may be attached to a container on a filling line. This is especially true in the fragrance industry where screw-on pumps have not been used with fragrance containers in part due to the speed at which filling lines typically run. In addition, screw-on type pumps are not typically desired for fragrance pumps and containers due to the breakage of bottles during the process of attaching the pumps to the bottles.

While such systems offer viable methods for securing pumps to containers, none of the existing systems allow a pump to be connected to a container in such a manner that the pump is removeable and is able to be attached to a container with the same speed as current crimp-on systems or pressure-type pump fitment systems. Thus, it would be advantageous for a pump to be connectable to a container with the speed of current filling practices and to be removable when desired such that a container, the pump, or both may be recycled.

BRIEF SUMMARY OF THE INVENTION

According to certain embodiments of the invention a pump may be assembled to a container using a snap-fitment system and then disassembled by twisting the pump off of the container. In some embodiments, disassembly of a pump from a container prevents reuse of the pump while allowing reuse of the container.

A pump according to embodiments of the invention may include a fitment having a body wall and a bottom portion thereof, or skirt portion, configured to secure the fitment to a container. In some embodiments of the invention, the skirt portion may slant or slope towards an interior of the fitment. Placement of a collar over the fitment may push or force the skirt portion inward such that the skirt portion may secure the fitment to a neck of a container. According to embodiments of the invention, a fitment may also include one or more thread guides on an interior portion of the fitment body. The one or more thread guides may communicate with, ride along, or cooperate with one or more threads on a container neck to facilitate removal of the fitment and pump from the container through a twisting motion. The fitment may also include one or more openings in a bottom portion of the body or skirt portion such that as a fitment or pump is twisted off of a container, the one or more openings allow the body or skirt portion to flex and release engagement with the neck of the container. The flexing of the body or skirt portion allowed by the one or more openings helps to enable removal of the pump and fitment from a container.

According to various embodiments of the invention, a pump may include a pump engine, a fitment, and a collar. The pump engine may be supported by the fitment and may pass through the fitment as conventionally known. The collar may be secured to an upper portion of the fitment prior to assembly. The pump engine, fitment and collar assembly may be used on a filling line such that the pump may be attached to a container containing a product such as a perfume or fragrance. During a filling process, a portion of the pump may be inserted into a container containing a product and the fitment may be pressed over the neck of the container. The collar may then be forced over the fitment such that a lower portion of the fitment, such as a skirt portion, secures the fitment and the pump to the neck of the container. The pump may later be removed from the container by twisting the pump off of the container. One or more thread guides associated with the fitment may facilitate removal of the pump from the neck of the container.

According to some embodiments of the invention, a fitment may include a pump retention portion and a body portion. The body portion may also include a lower portion or skirt portion which may be angle or sloped inwards. In other embodiments, the lower portion of the body or skirt portion may be sloped outwards. In either configuration, positioning of a collar over the fitment may force a portion of the skirt portion under a bottom portion of a neck of a container such that the fitment may retain a pump on the container.

In various embodiments of the invention, a fitment may also include one or more openings in the fitment body, in a skirt portion of the body, or in both a skirt portion of the body and the body. The one or more openings may allow the skirt portion or body to flex during removal of the fitment from a container such that the fitment may be twisted off of a container.

In still other embodiments of the invention, a fitment may include one or more thread guides on an interior portion of the fitment. The one or more thread guides may mate with, communicate with, be guided by, or otherwise cooperate with one or more threads on a container neck during removal of the fitment from a container. In some embodiments, the one or more thread guides may act in conjunction with one or more openings in a skirt portion of the body such that interaction of the one or more thread guides with one or more threads of a container exerts sufficient force on the fitment to cause the skirt portion to flex and release the fitment from connection with the container.

According to various embodiments of the invention, once a fitment has been removed from a container, the collar may apply sufficient forces on the skirt portion of the fitment such that the skirt portion is angle towards and interior of the fitment. The angle of the skirt portion may be sufficient to prevent the reattachment of the fitment to a container. Thus, once removed from a container, a fitment, or pump held by the fitment, may not be reattached to a container or reused. However, the release of the pump and fitment from the container may allow the container to be recycled or reused with a new pump.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to embodiments of the invention, a dispenser assembly may include a pump and a container. A pump 200 and container 120 may be connected using a fitment 210 which allows a pump 200 to be removed from a container 120 after being attached to the container 120.

Figure 1A:
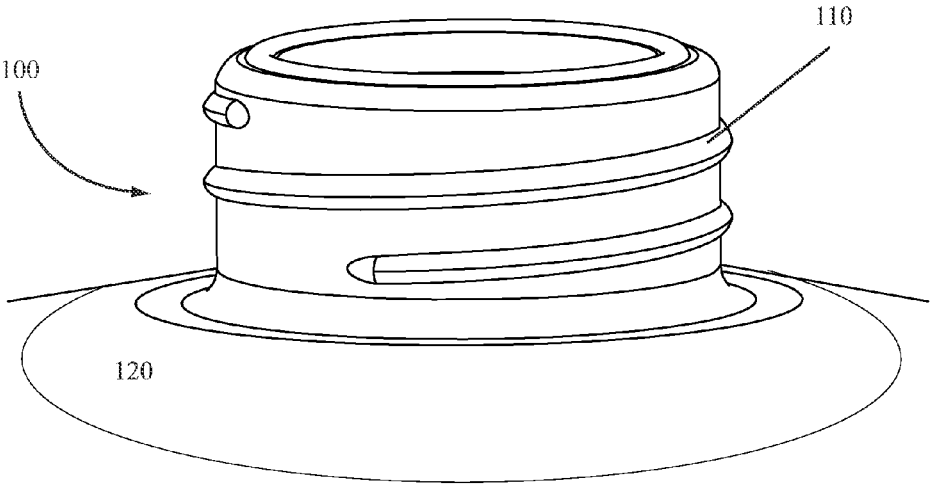
FIGS. 1A, 1B and 1C illustrate containers according to various embodiments of the invention.
Figure 1B:
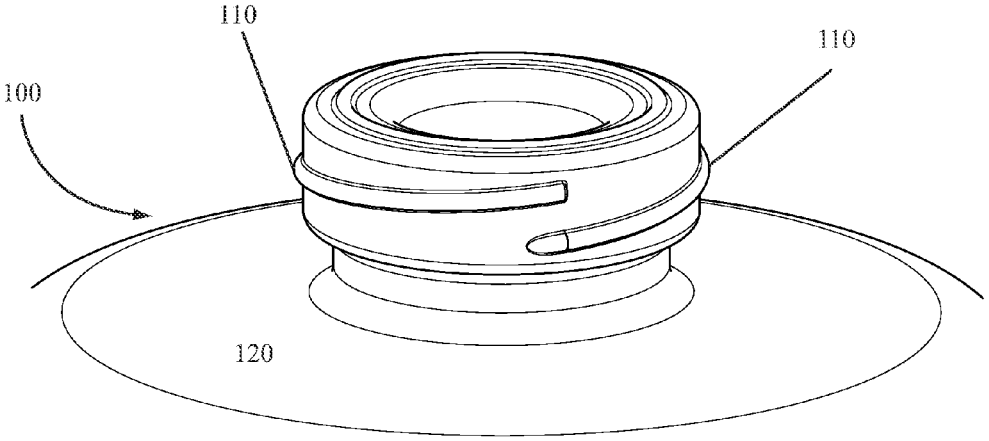
Figure 1C:
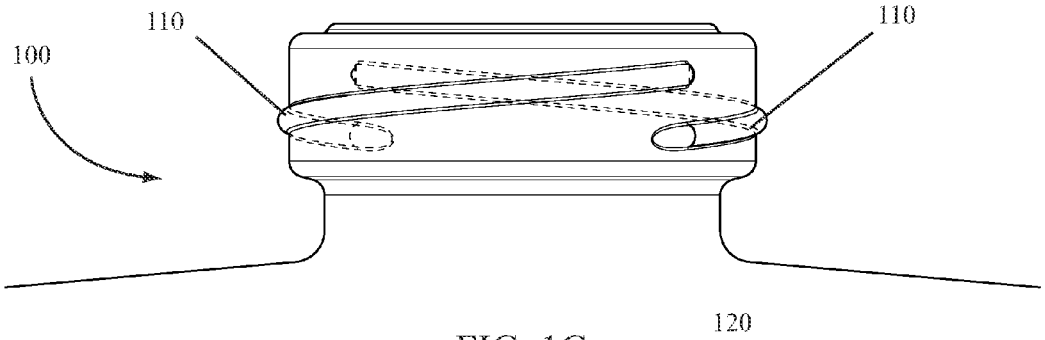

In some embodiments of the invention, the container 120 may include a neck 100 having one or more threads 110 protruding from the neck 100 or carved into the neck 100 of the container 120. For example, a container 120 may have a single thread 110 protruding from the neck 100 as illustrated in FIG. 1A. In other embodiments, two or more threads 110 may protrude from the neck 100. For example, as illustrated in FIG. 1B, two one hundred and eighty degree twisting threads 110 protrude from the neck 100. An alternative view of the two or more threads 110 on a neck 100 of a container 120 is further illustrated in FIG. 1C. The angle, pitch, depth, shape, and size of the one or more threads 110 may be configured to secure a fitment 210 to the container 120 when the fitment 210 has been assembled.

Figure 2A:
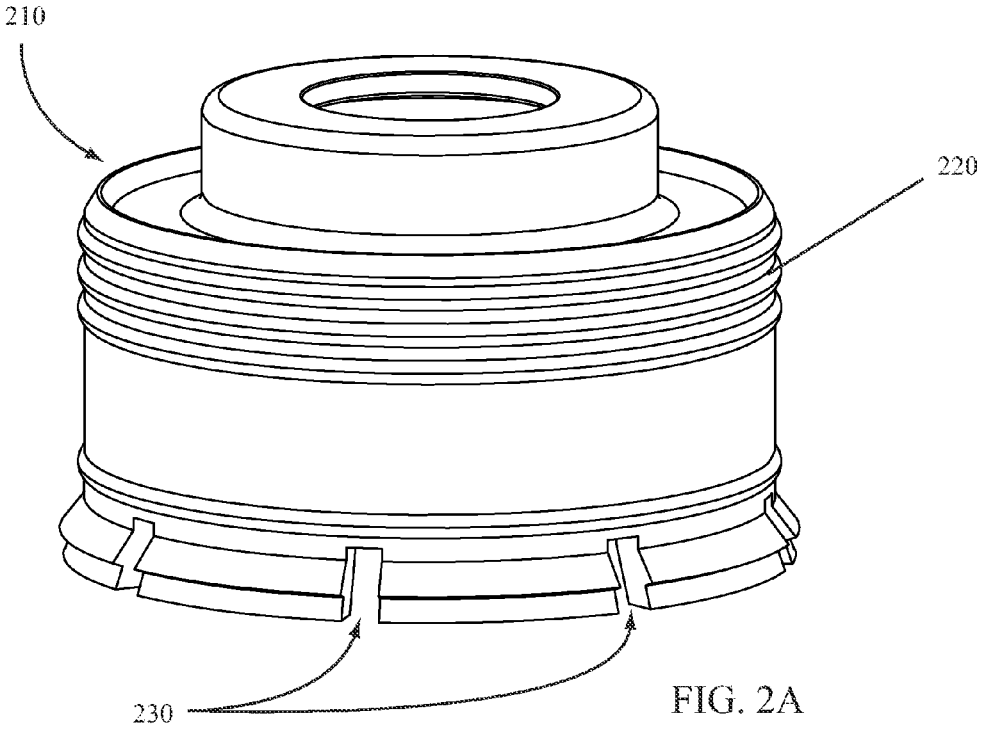
FIGS. 2A and 2B illustrate fitments according to various embodiments of the invention.
Figure 2B:
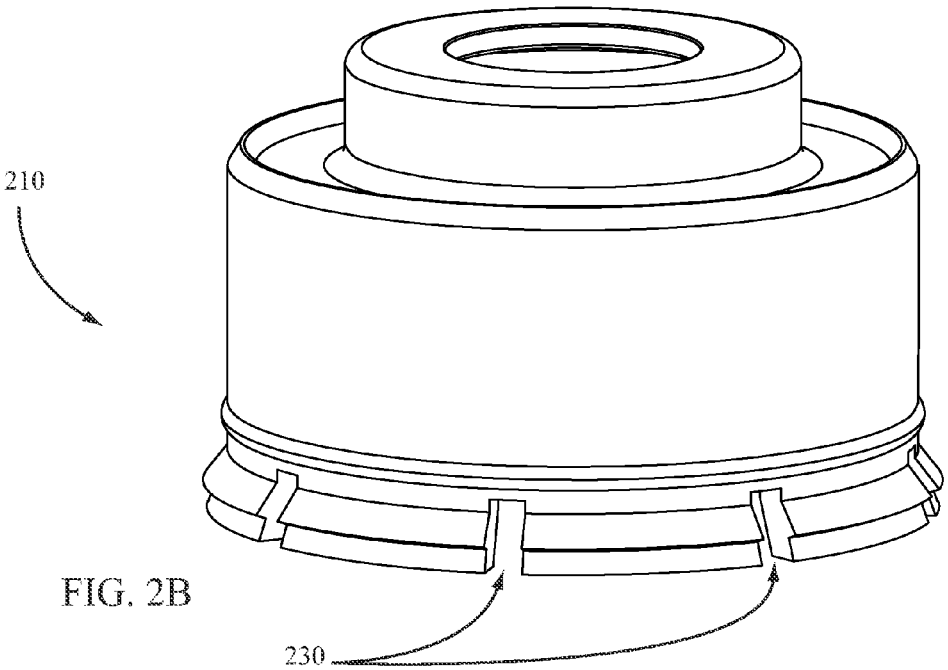

A fitment 210 according to various embodiments of the invention is illustrated in FIG. 2A. A fitment 210 may be configured to slide over the neck 100 of a container 120. The fitment 210 may include one or more protrusions 220 or other features that may assist with securing a collar 250 to the fitment 210 when a pump engine 300 is fitted to a container 120 using a connector fitment 200. In other embodiments, a fitment 210 may not include such protrusions 220, but may instead have a substantially smooth outer wall, or outer wall lacking numerous protrusions 220, as illustrated in FIG. 2B. In some embodiments, the fitment 210 may include features allowing the fitment 210 to mate with one or more threads 110 of the container 120 to secure the fitment 210 to the container 120 and to prevent all but rotational removal of the fitment 210 from the container 120.

A fitment 210 according to embodiments of the invention may also include one or more openings 230 in a base of the fitment 210 as illustrated in FIG. 2. In some embodiments, multiple openings 230 may be included in the fitment 210. In other embodiments, the number and size of the openings 230 may be limited.

A pump engine 300 according to various embodiments of the invention may include any conventional pump engine. For instance, a fragrance pump including a pump head, orifice, accumulator, piston, spring and one or more valves may be used with embodiments of the invention. In some embodiments, a pump engine 300 may include an accumulator, a piston seated in the accumulator, one or more valves for allowing fluid flow through the pump engine 300, and an orifice through which product may exit the pump engine 300. In some embodiments, a pump engine 300 may also include a dip tube configured to communicate a product to the accumulator of the pump engine 300. An orifice cup may also be used with a pump engine 300. In some embodiments, a pump engine 300 may also include a pump head or cap in communication with the piston.

Figure 3:
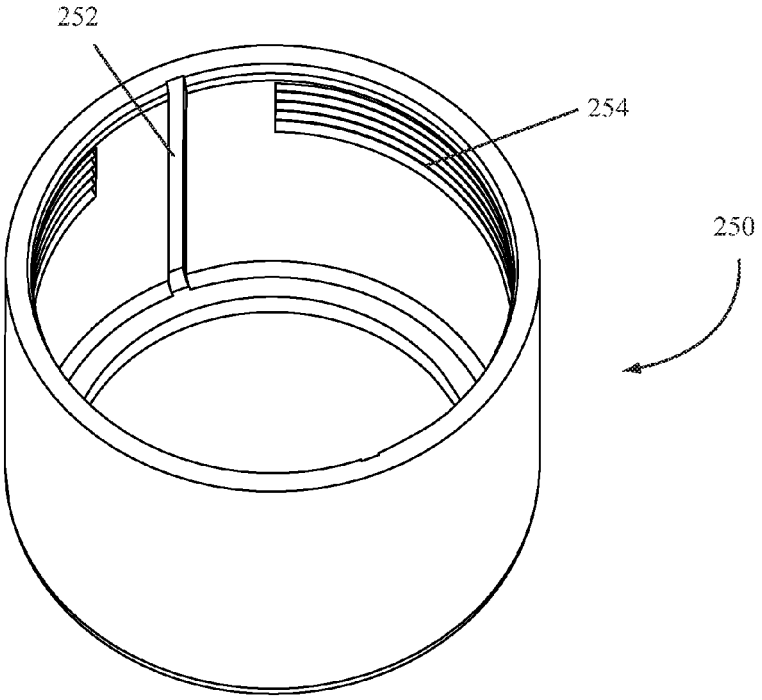
FIG. 3 illustrates a collar according to various embodiments of the invention.
Figure 4:
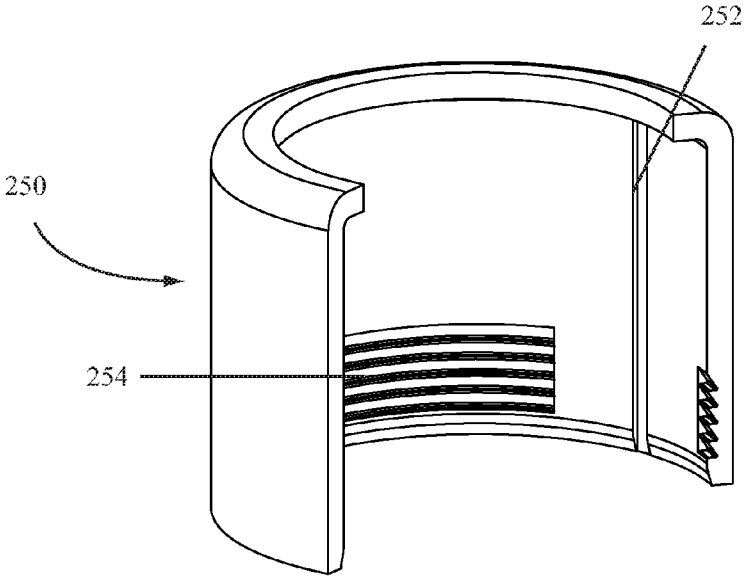
FIG. 4 illustrates a cross-sectional view of a collar according to various embodiments of the invention.

A collar 250 according to various embodiments of the invention is illustrated in FIGS. 3 and 4. A collar 250 may include one or more vertical grooves 252 or ridges. The vertical grooves 252 or ridges may fix the collar 250 to a fitment 210 or may be configured to prevent vertical removal of the collar 250 from a fitment 210 once a collar 150 has been assembled with a fitment 210 on a container 120. A collar 250 may also include one or more horizontal grooves 254 or ridges which may be configured to secure the collar 250 and a fitment 210 prior to assembly with a container 120 or to prevent movement of the collar 250 with respect to the fitment 210 once a fitment 210 is assembled onto a container 120.

Figure 10:
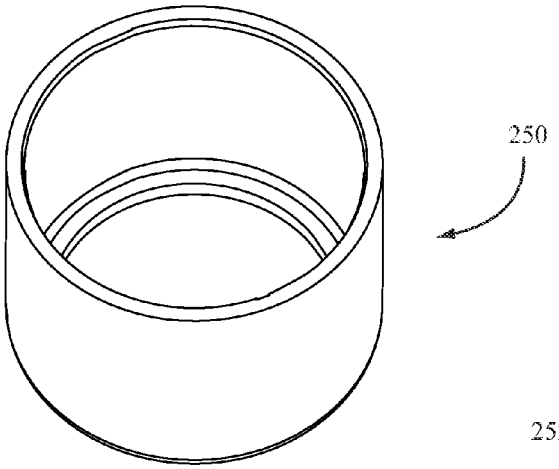
FIG. 10 illustrates a collar according to various embodiments of the invention.
Figure 11:
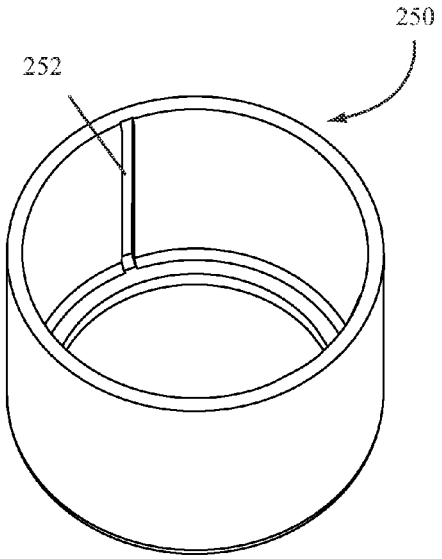
FIG. 11 illustrates a collar according to various embodiments of the invention.
Figure 12:
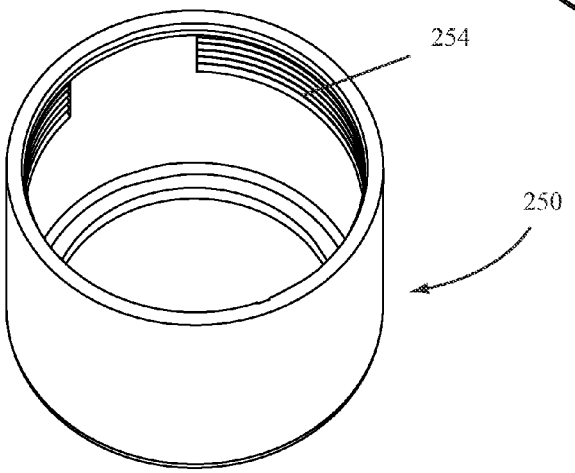
FIG. 12 illustrates a collar according to various embodiments of the invention.

According to other embodiments of the invention, a collar 250 may not include vertical grooves 252 or horizontal grooves 254 as illustrated in FIG. 10. In other embodiments, a collar 250 may include vertical grooves 252 and no horizontal grooves 254 as illustrated in FIG. 11. In still other embodiments of the invention, a collar 250 may include horizontal grooves 254 but no vertical grooves 252 as illustrated in FIG. 12.

Figure 5:
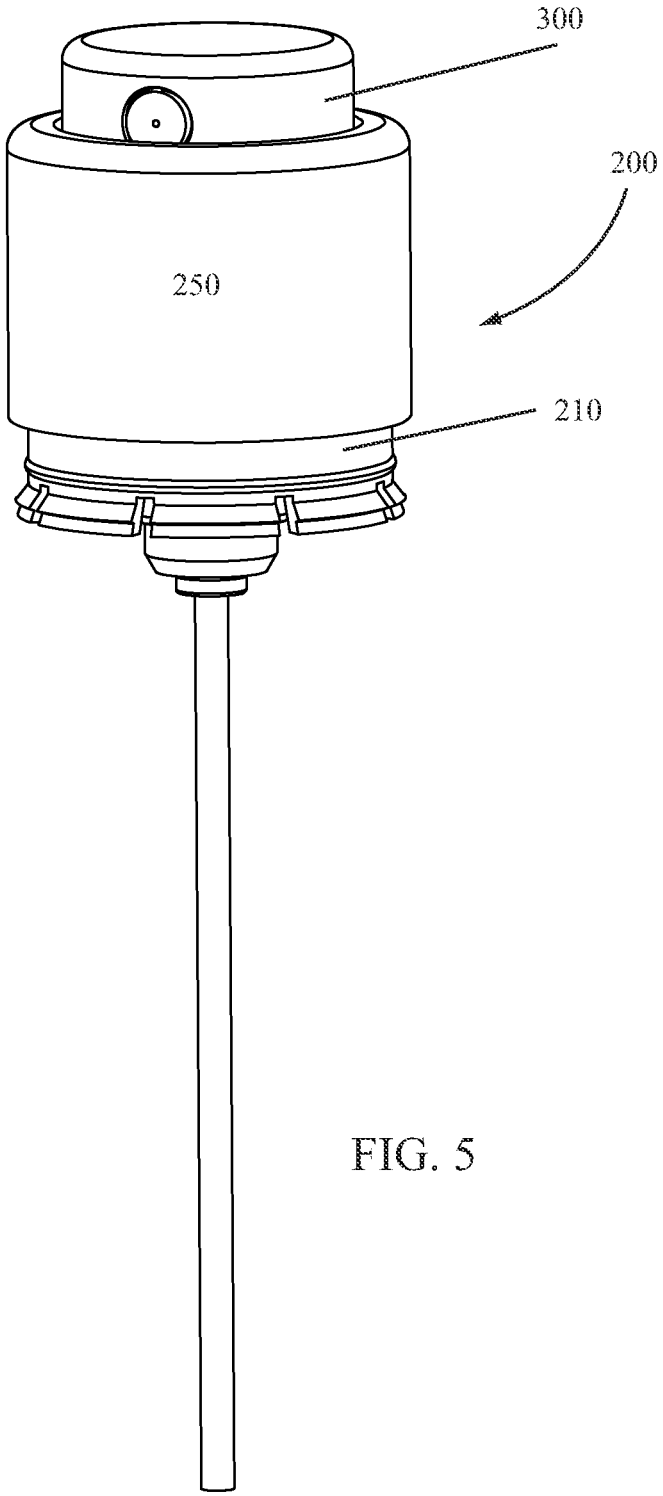
FIG. 5 illustrates a pump and a connector fitment including a fitment and collar according to various embodiments of the invention.

A pump 200 according to various embodiments of the invention includes an assembly of a pump engine 300, a fitment 210 and a collar 250 as illustrated in FIG. 5. The pump 200 illustrated in FIG. 5 is in a state or configuration ready to be assembled to a container 120 on a fill line.

Figure 6:
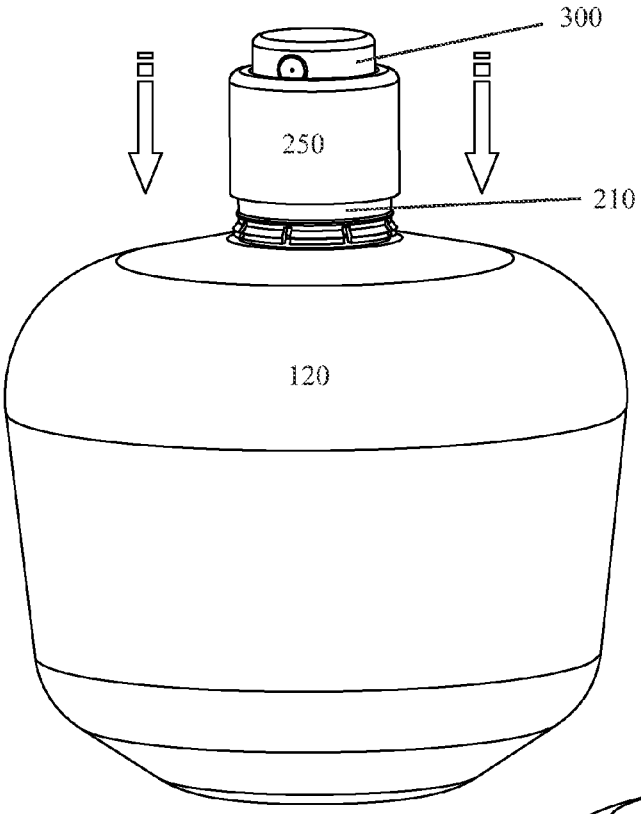
FIG. 6 illustrates a method for assembling a connector fitment with a container according to various embodiments of the invention.

According to embodiments of the invention, a pump engine 300, collar 250 and fitment 210 may be preassembled as a pump 200 such that the pump 200 may be delivered to a fill line and assembled onto a container as illustrated in FIG. 6. When a pump 200 is assembled to a container 120, the pump 200 may be inserted at least into a portion of the interior of the container 120 such that the fitment 210 rests on an upper portion of the neck 100 of the container 120. The fitment 210 may then be forced over the neck 100 and the collar 250 may slide over the fitment 210 securing the pump engine 300 to a container 120 as illustrated in FIG. 6.

Figure 7:
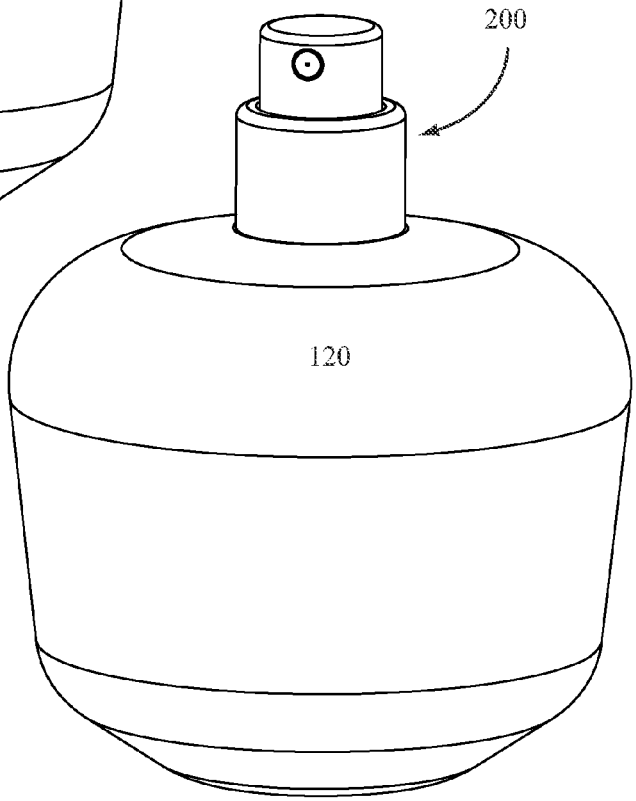
FIG. 7 illustrates an assembled pump and container according to various embodiments of the invention.

A pump 200 assembled to a container 120 using a fitment 210 and collar 250 according to embodiments of the invention is illustrated in FIG. 7.

Figure 8:
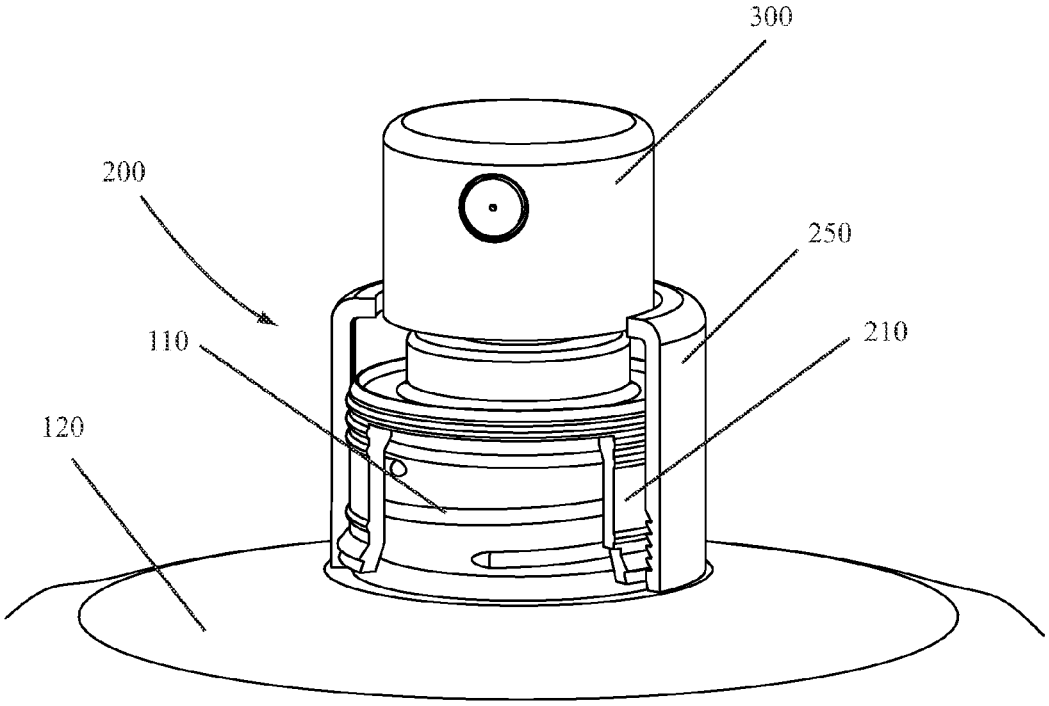
FIG. 8 illustrates a cut-out view of a connector fitment and pump assembled to a container according to various embodiments of the invention.

A cut-away view of a pump 200 attached to a container 120 according to embodiments of the invention is illustrated in FIG. 8. A collar 250 fixes the fitment 210 onto the neck 100 of the container 120. One or more threads 110 of the container 120 mate with or are configured to secure the fitment 210 with the container 120. The collar 250 may keep the fitment 210 mounted on the one or more threads 110.

In some embodiments, the connection between the fitment 210 and one or more threads 110 may be configured to prevent vertical removal of the pump 200 from the container 120. In various embodiments, the fitment 210 may rotate about a central axis of the container 120 such that the fitment 210 may be screwed off of the one or more threads 110, allowing the pump 200 to be removed from the container 120. The angles, sizes, and configuration of the mating or connection of the fitment 210 and one or more threads may be altered to meet the desired rotational resistance required for removal of a pump 200 from a container 120.

Figure 9:
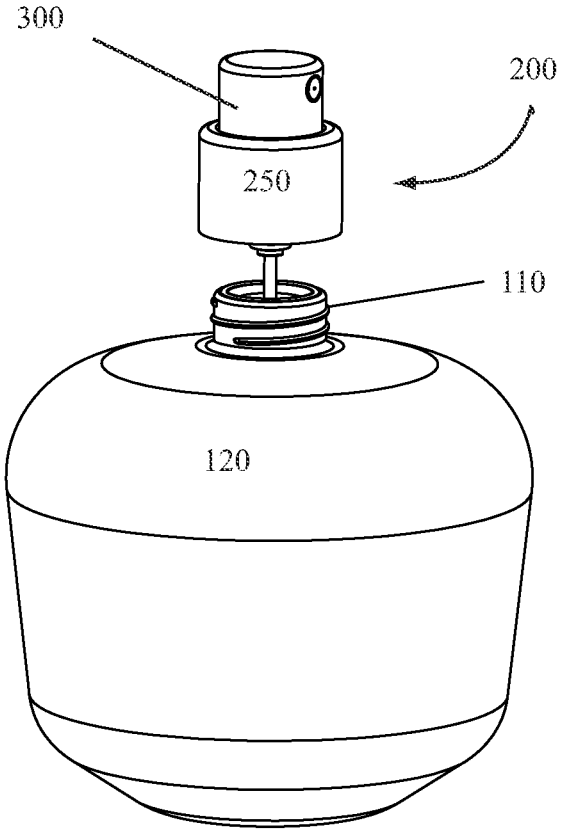
FIG. 9 illustrates a disassembled pump and container according to various embodiments of the invention.

A pump 200 in a disassembled state from a container 120 is illustrated in FIG. 9. A pump 200 may be removed from a container 120 by unscrewing or rotating the pump engine 300 and connector fitment 200 from the container 120. Unlike the pump 200 illustrated in FIG. 5, a pump 200 removed from a container 120 may be unusable again because the collar 250 does not remove itself from the fitment 210 when the pump 200 is unscrewed from the container 120. The force exerted by the collar 250 on the fitment 210 prevents the base or skirt of the fitment 210 from expanding sufficiently to be reattached to a container 120.

According to various embodiments of the invention, a pump 200 may be assembled to a container 120 such that the pump 200 may not be pulled off of the container 120 due to interaction between a fitment 210 and one or more threads 110 on the container 120. However, the pump 200 may be removed from the container 120 by rotating the pump 200 off of the container 120. The mating or connection between the fitment 210 and the one or more threads 110 of the container 120 may allow such removal, providing for a method to recycle the container 120 or reuse the container 120.

Figure 13:
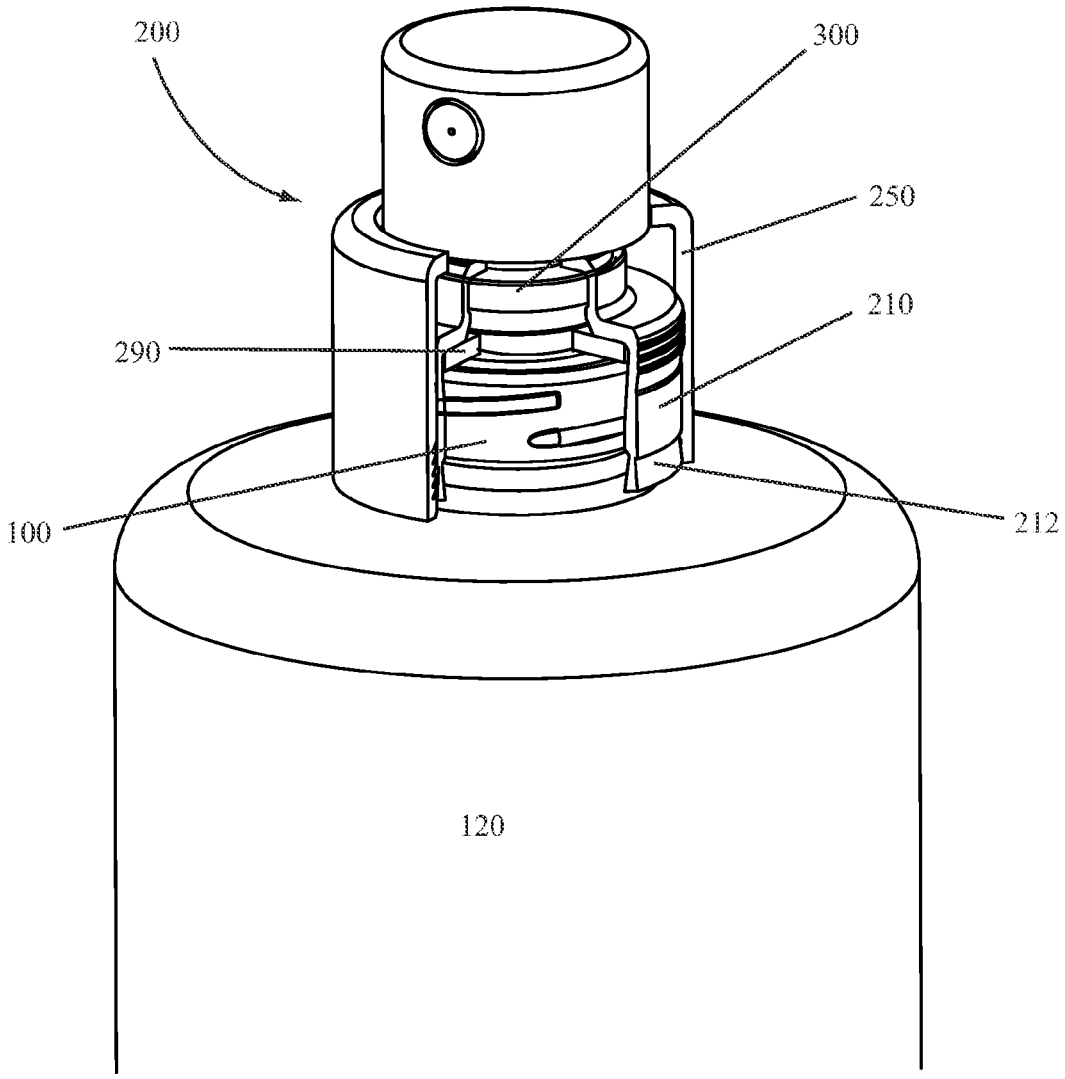
FIG. 13 illustrates a pump according to various embodiments of the invention attached to a container.

A cut-away view of a pump 200 according to various embodiments of the invention assembled on a container 120 is illustrated in FIG. 13. As illustrated, the pump 200 may include a pump engine 300 secured to a container 120 by a fitment 210 and a collar 250. In some embodiments, a gasket or ring seal 290 may also be seated between the fitment 210 and the neck 100 of the container 120. The gasket or ring seal 290 may improve a seal between the pump 200 and the container 120.

Figure 14:
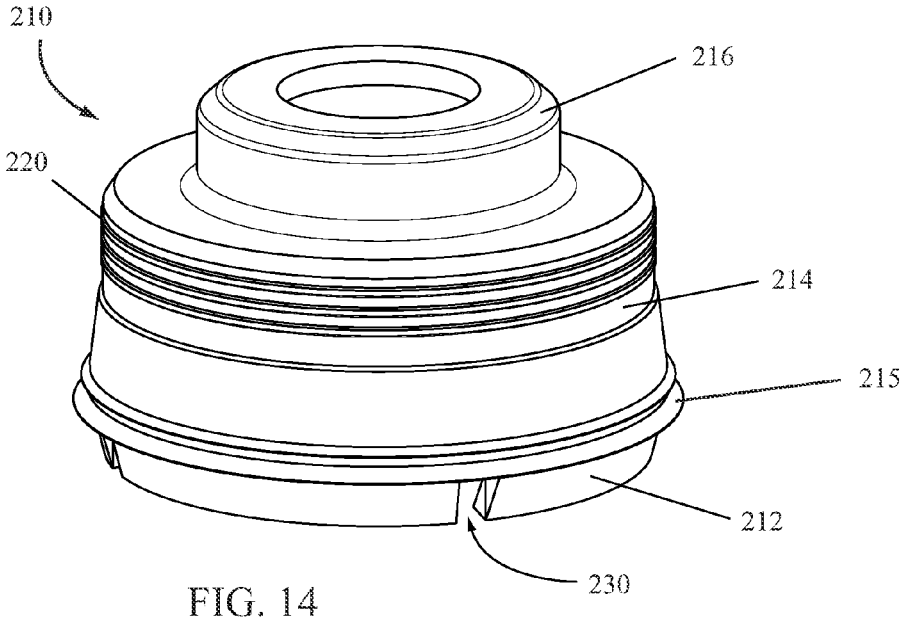
FIG. 14 illustrates a fitment according to various embodiments of the invention.
Figure 15:
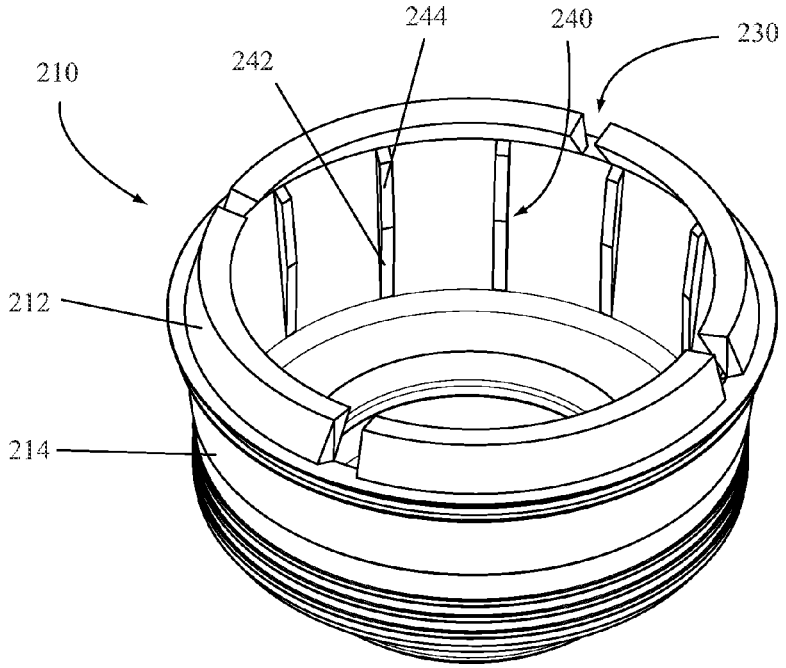
FIG. 15 illustrates a fitment according to various embodiments of the invention.
Figure 16:
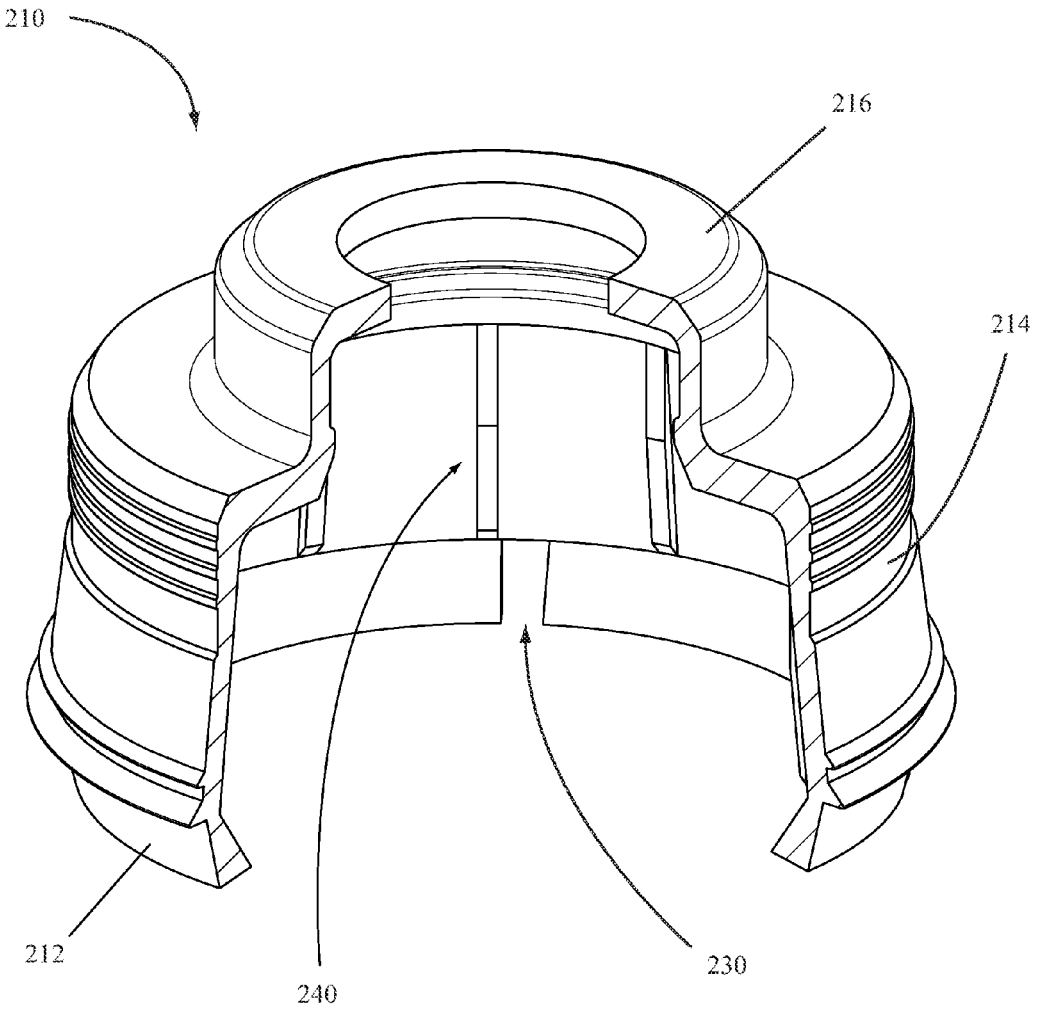
FIG. 16 illustrates a cut-away view of a fitment according to various embodiments of the invention.

As illustrated in FIG. 13, a fitment 210 may include a lower skirt 212. For example, a fitment 210 according to various embodiments of the invention is further illustrated in FIGS. 14 through 16. According to various embodiments of the invention, a fitment 210 may include a skirt 212, a pump retention portion 216, and a body wall between the skirt 212 and pump retention portion 216. In some embodiments of the invention, a body wall 214 may be circular, oval, conical, square, or other desired shape. As illustrated in FIGS. 14 through 16, a body wall 214 may be circular or conical in shape. One or more protrusions 220 may be included on an exterior portion of the body wall 214 as illustrated. In other embodiments, an exterior portion of a body wall 214 may also be smooth or may lack multiple protrusions 200.

According to various embodiments of the invention, a pump retention portion 216 of a fitment 210 may be shaped or configured to retain a pump 300 on a container 120. A pump retention portion 216 of a fitment 210 may include one or more openings through which portions of a pump 300 may pass such that portions of a pump 300 are positioned on an interior portion of the fitment 210 and on an exterior portion of the fitment 210 extending through the pump retention portion 216 of the fitment 210. While particular configurations of pump retention portions 216 of fitments 210 according to embodiments of the invention are illustrated, it is understood that the pump retention portion 216 of a fitment 210 may be configured in many different ways to accommodate the configuration of a pump 300 being retained with a fitment 210.

According to various embodiments of the invention, a skirt 212 of a fitment 210 may be integral with a lower portion of the body wall 214 of the fitment 210. As illustrated in FIGS. 14 through 16, a skirt 212 may have a slope or be angled towards an interior portion of the fitment 210. In other embodiments of the invention, a skirt 212 may slope away from an interior portion of the fitment 210 or may be substantially parallel to a center axis of a fitment 210.

A fitment 210 may also include one or more openings 230 in the skirt 212 portion of the fitment 210 or one or more openings 230 thorough both a skirt 212 and a portion of the body wall 214 of a fitment 210.

In some embodiments of the invention, a fitment 210 may include one or more lips 215 adjacent to a skirt 212. When a collar 250 is pushed over a fitment 210 to attach a pump 200 to a container 120, the collar 250 may exert forces on the one or more lips 215 which in turn may force the skirt 212 to exert a force on the neck 100 of the container 120 or push the skirt 212 into a position in which the skirt 212 helps to secure the fitment 210 to the container 120. For example, as illustrated in FIG. 13, a skirt 212 may be secured about a lower portion of the neck 100 of a container 120 by the forces exerted on the skirt 212 or one or more lips 215 by the collar 250.

A fitment 210 according to embodiments of the invention may also include one or more thread guides 240 positioned on an interior portion of a fitment 210 body wall 214 as illustrated in FIGS. 15 and 16. According to embodiments of the invention, a thread guide 240 may include a design or shape configured to mate with one or more threads 110 on the neck 100 of a container 120. The one or more thread guides 240 may be configured such that a portion of the one or more thread guides 240 seats between the threads 110 of the container 120 and interact with the threads 110 upon the twisting of a pump 200 assembled to a container 120. As the pump 200 is twisted, the one or more thread guides 240 may interact with or engage the one or more threads 110 to guide a pump 200 off of the container 120 and supply sufficient force on a skirt 212 to allow the skirt 212 to release the connection with the container 120. According to other embodiments of the invention, the one or more thread guides 240 may be configured to ride over one or more threads 110 such that the one or more threads 110 exert a force on the one or more thread guides 240 which in turn exert a force on a skirt 212 or body wall 214 of the fitment 210. While particular designs and configurations of the one or more thread guides 240 are illustrated, it is understood that the thread guides 240 may be configured, shaped, and positioned on, in, or integral with a fitment 210 as desired in order to facilitate removal of a pump 200 from a container 120 according to embodiments of the invention.

According to various embodiments of the invention, a thread guide 240 may include a first sloping portion 242 and a second sloping portion 244. The first sloping portion 242 and second sloping portion 242 may meet at a peak as illustrated in FIG. 15. The peak of the sloping portions of the thread guide 240 may be configured such that when a pump 200 is assembled to a container 120, the peak may rest between one or more threads 110 of the container 120. In other embodiments, a thread guide 240 may include a plurality of sloping portions forming multiple peaks such that the multiple peaks may be configured to interact with one or more threads 110 of a container 120 when a pump 200 is being disassembled from a container 120. According to some embodiments of the invention, one or more peaks may be located in a similar plane running perpendicular to a center axis of the fitment 210. According to other embodiments, one or more peaks may be located in different planes running perpendicular to a center axis of the fitment 210.

A cut-away view of a fitment 210 according to various embodiments of the invention is illustrated in FIG. 16. The fitment 210 may include a body wall 214, a pump retention portion 216, a skirt 212, one or more openings in the skirt 212, and one or more thread guides 240 on an interior portion of the fitment 210.

Figure 17:
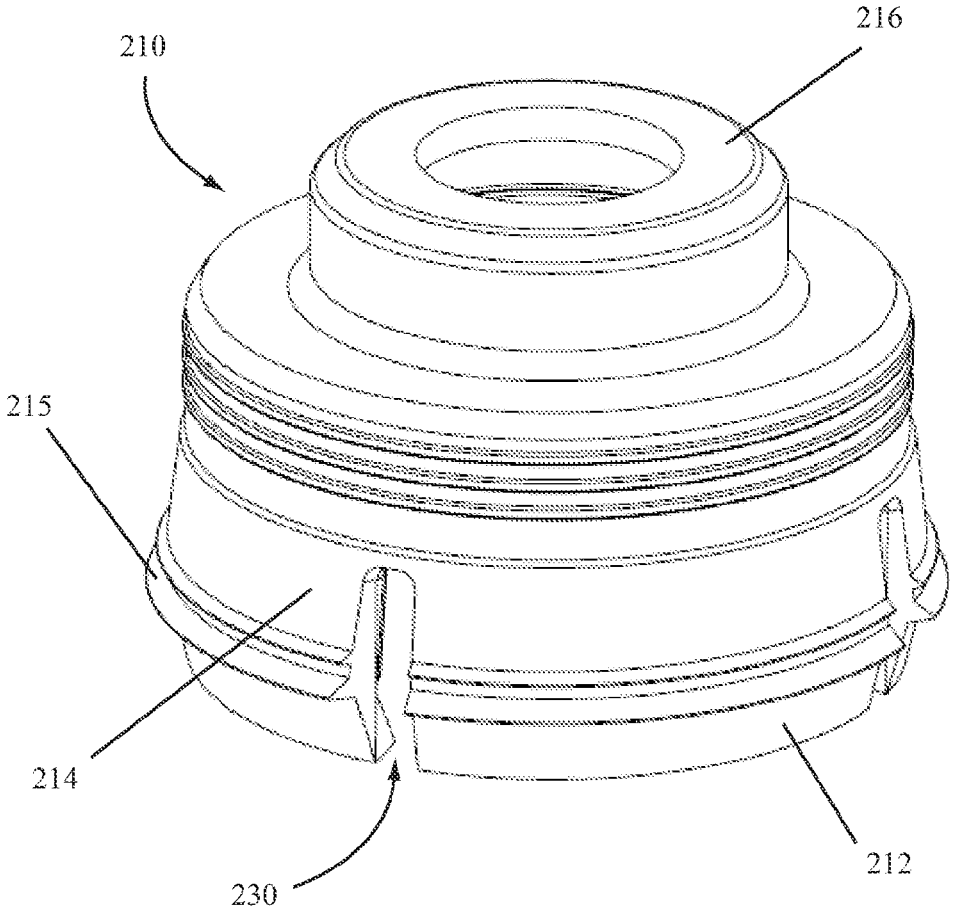
FIG. 17 illustrates a fitment according to various embodiments of the invention.

A fitment 210 according to other various embodiments of the invention is illustrated in FIG. 17. In some embodiments, the one or more openings 230 in a skirt 212 of a fitment 210 may extend into a portion of the body wall 214 as illustrated. The size and shape of the one or more openings may be configured to provide a desired force on the skirt 212 or lower portion of the body wall 214 during assembly and disassembly of a pump 200 with a container 120.

According to other embodiments of the invention, a fitment 210 may lack a skirt 212. Instead, a body wall 214 may be shaped or configured such that a lower portion of the body wall 214 takes the place, acts like, or performs the same function that a skirt 212 performs with other embodiments of the invention. Further, while various embodiments of the invention have been described as having a skirt 212, the skirt 212 may also be considered a lower portion of, extension of, or skirt portion of the body wall 214. For example, the skirt 212 illustrated in FIG. 17 may be considered to be part of, or an extension of, the body wall 214.

Figure 18:
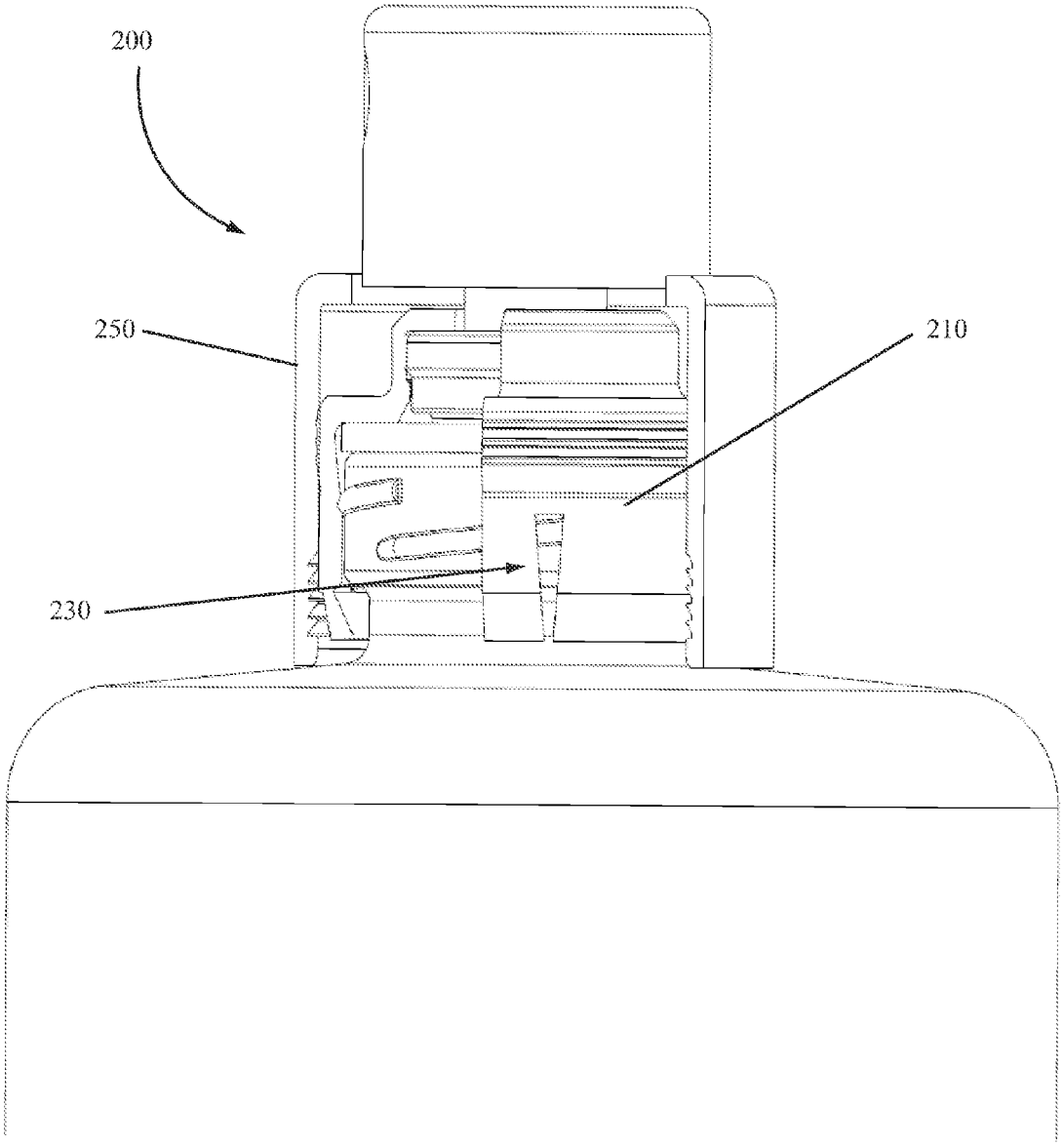
FIG. 18 illustrates a cut-away view of a pump assembled to a container according to various embodiments of the invention.

A pump 200 having a fitment 210 as illustrated in FIG. 17 and assembled to a container 120 is illustrated in FIG. 18. When assembled, a skirt 212 of the fitment 210 may be pressed towards a neck 100 of the container 120 by a collar 250 such that a portion of the skirt 212 grips or secures the fitment 210 to a bottom portion or underside of the neck 100 of the container 120 as illustrated in FIG. 18. In an assembled position, the one or more openings 230 in the fitment 210 allow the skirt 212 or bottom portion of the body wall 214 to flex under the bottom portion of the neck 100 to secure the pump 200 to the container 120. As illustrated, the one or more openings 230 may collapse at the lower rim of the fitment 210 to allow the skirt 212 to flex or be positioned under the bottom portion of the neck 100 of the container 120. Attempted removal of a pump 200 attached as illustrated in FIG. 18 by forces exerted in a vertical direction or direction away from the container 120 is hindered by the positioning of the skirt 212 around a bottom portion of the neck 100 of the container 120. Thus, in the assembled configuration illustrated in FIG. 18, a pump 200 cannot be removed, or cannot be easily removed, by application of an upwards or vertical force on the pump 200.

Figure 19:
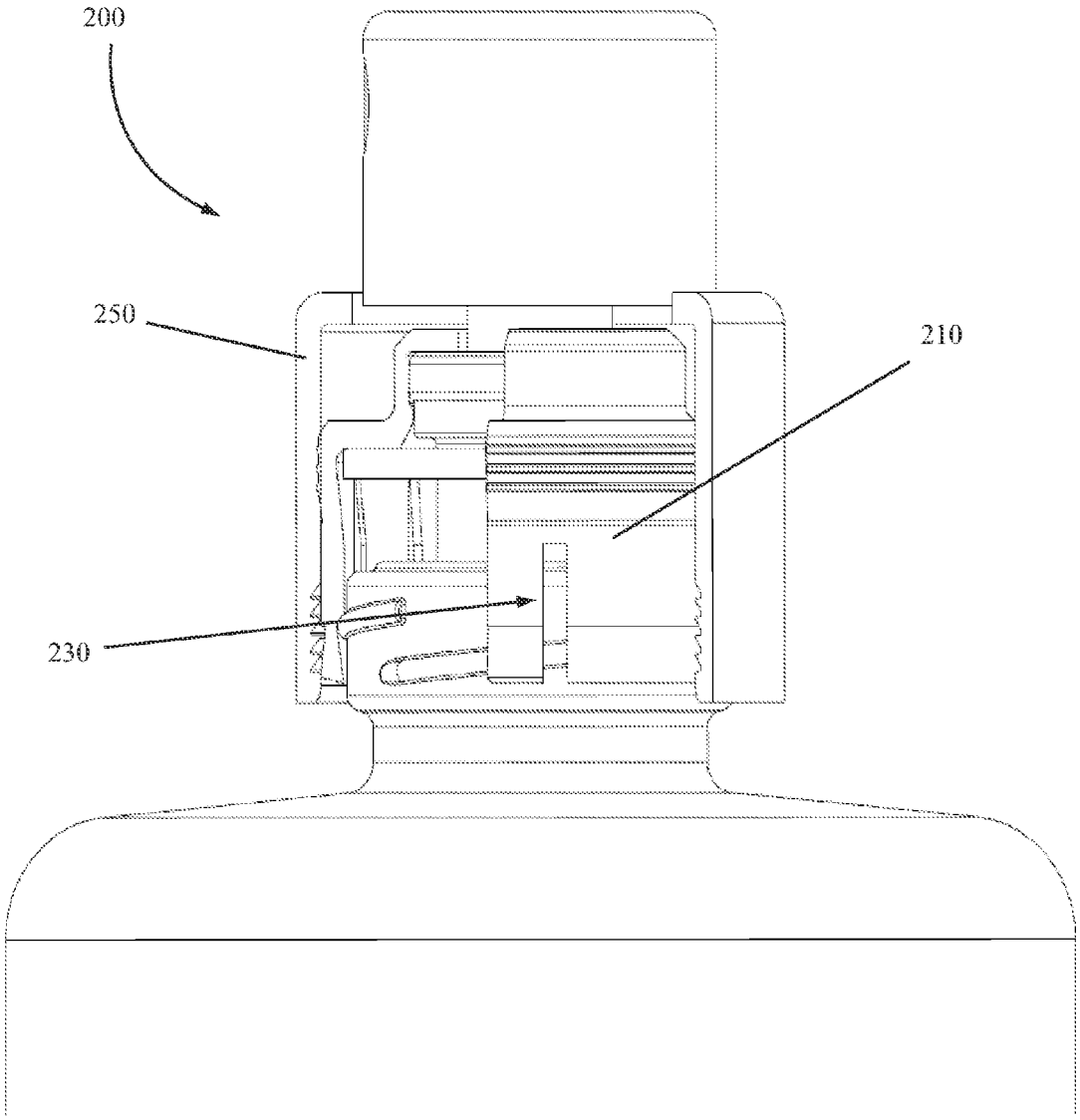
FIG. 19 illustrates a cut-away view of a pump according to various embodiments of the invention being removed from a container.
Figure 20:
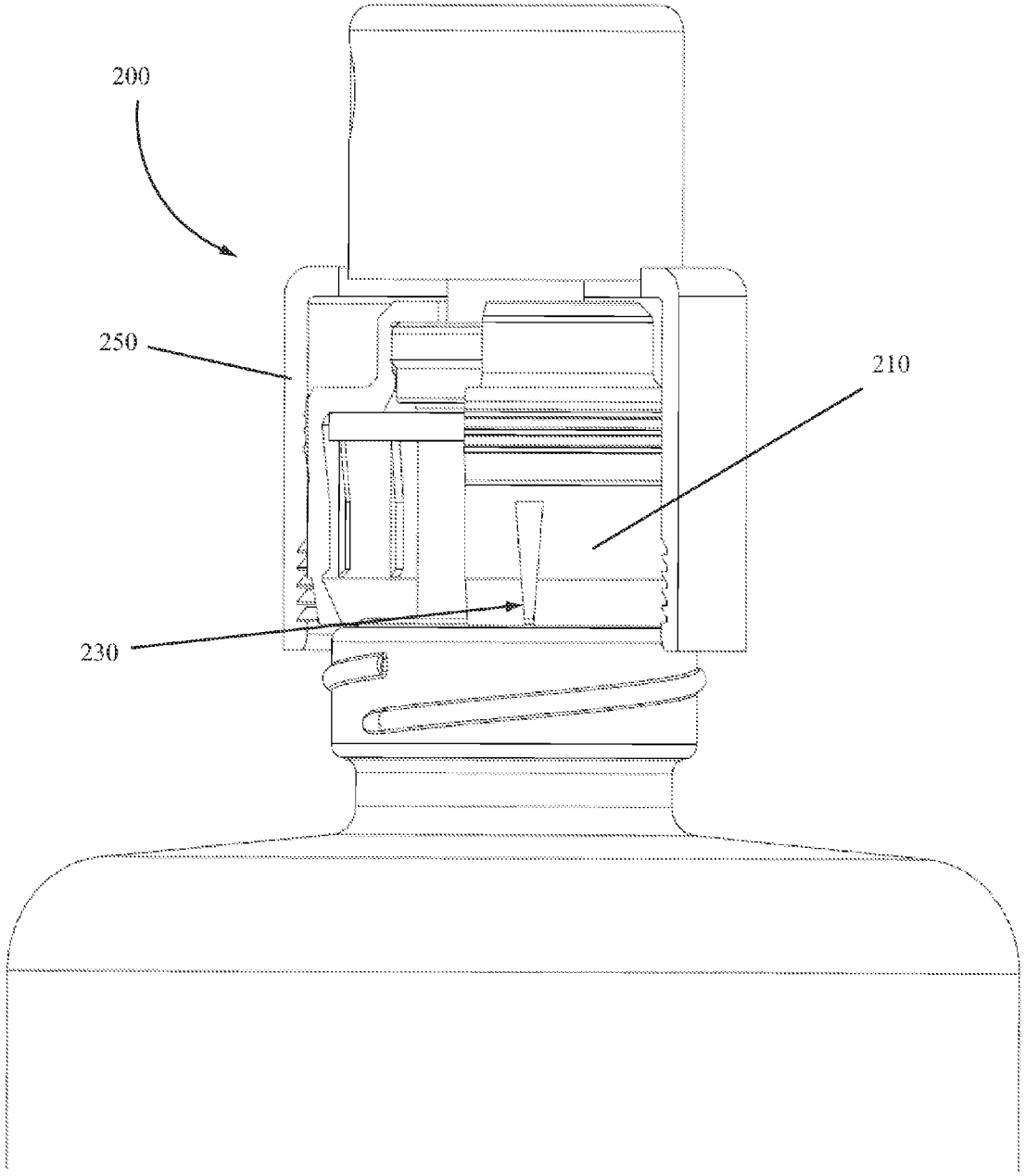
FIG. 20 illustrates a cut-away view of a pump according to various embodiments of the invention disassembled from a container.

A pump 200 according to various embodiments of the invention, however, may be removed by a twisting motion as illustrated in FIGS. 19 and 20. As a pump 200 is twisted, one or more thread guides 240 on an interior of the fitment 210 may follow one or more threads 110 on the neck 100 of the container 120. As the one or more thread guides 240 ride or follow the one or more threads 110, forces are exerted on the skirt 212 or bottom portion of the body wall 214. The one or more openings 230 allow the skirt 212 to flex outward, releasing the connection of the fitment 210 or skirt 212 with the bottom portion of the neck 100 of the container 120 as illustrated in FIG. 19. Continued twisting of the pump 200 allows the pump 200 to be released from the container 120 as illustrated in FIG. 20. The pump 200 and the container 120 may then be recycled or disposed of separately. This also allows the container 120 to be refilled and fitted with another pump 200.

Figure 21:
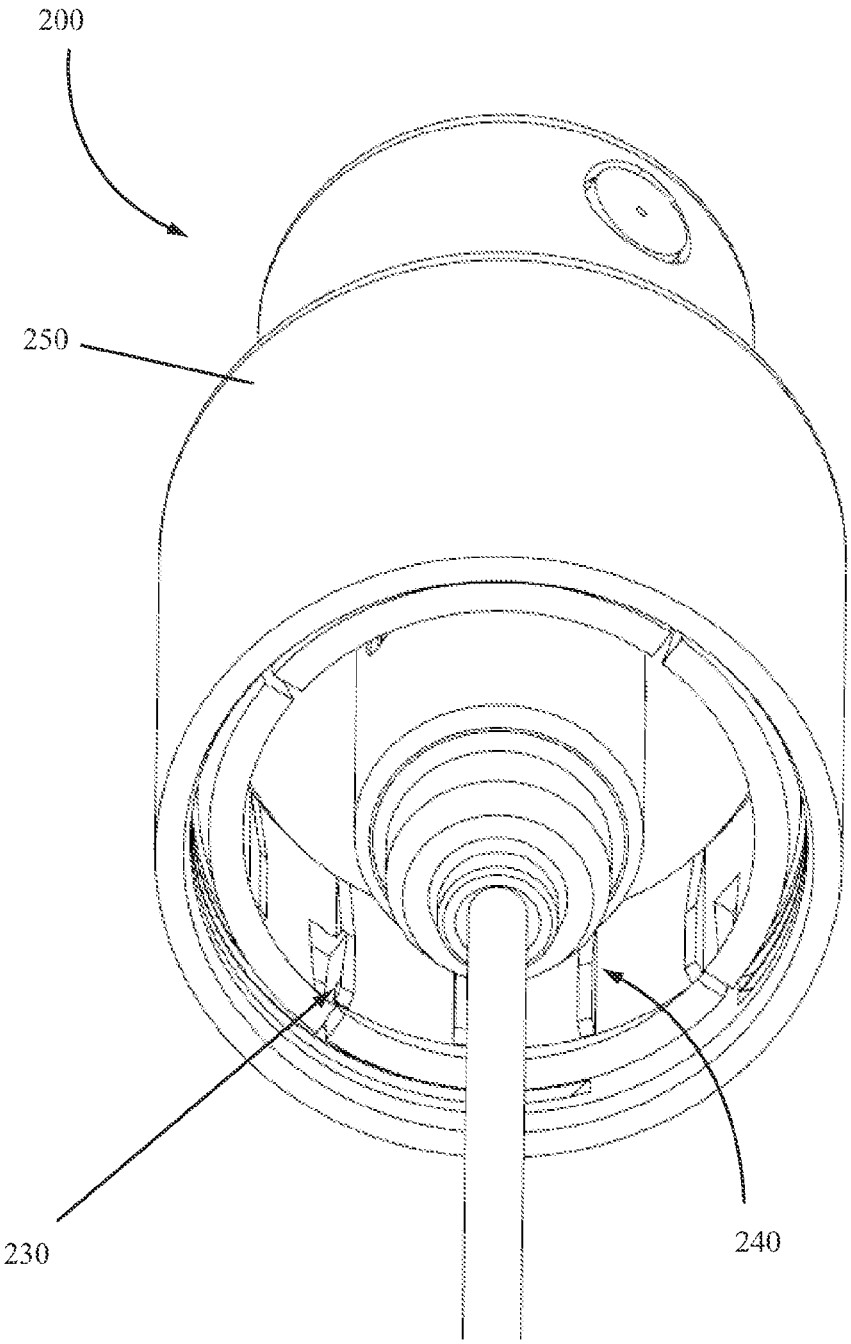
FIG. 21 illustrates a pump according to various embodiments of the invention disassembled from a container.

Upon release of the pump 200 from the container 120, the forces exerted by the collar 250 on the fitment 210 return the skirt 212 to a crimped or inward sloping position as illustrated in FIGS. 20 and 21. The positioning of the skirt 212 in a crimped or inward sloping position prevents the reattachment of the pump 200 to another container 120. Thus the pump 200 may recycled or disposed of and the container 120 reused or recycled.

According to various embodiments of the invention, a pump 200 may be molded and partially assembled to a configuration as illustrated in FIG. 5. A container 120 may be filled with a product, such as a perfume or fragrance product, and a partially assembled pump 200 may be attached to the container 120 using conventional filling line attachment procedures as illustrated in FIGS. 6 and 7. The pump 200 may later be removed from the container 120 in a manner similar to that illustrated in FIGS. 18 through 20. The pump 200 may then be recycled or disposed of and the container 120 recycled, disposed of, or reused with a new pump 200.

According to various embodiments of the invention, a fitment 210, a collar 250, and other components of a pump 200 may be made of a plastic or resin material. For example a fitment 210 may be molded from a plastic material such as polypropylene, high-density polypropylene, medium-density polypropylene, polyurethanes, or other materials.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A pump assembly, comprising:

a fitment, comprising:

a pump retention portion;

a skirt extending off a bottom of a body wall and angled toward an interior of the fitment;

at least one opening in the skirt;

the body wall being between the pump retention portion and the skirt;

at least one protrusion on an outer surface of the body wall; and at least one thread guide on an interior surface of the body wall;

a pump engine retained by the pump retention portion of the fitment; and a collar secured to the at least one protrusion.

2. The pump assembly of claim 1, further comprising at least one opening through the skirt and into a portion of the body wall of the fitment.

3. The pump assembly of claim 1, wherein the at least one thread guide further comprises:

a first sloping portion; and a second sloping portion, wherein the first sloping portion and the second sloping portion meet at a peak.

4. The pump assembly of claim 1, wherein the fitment further comprises a fitment made of a plastic material.

5. A dispenser assembly, comprising:

a container, comprising:

a neck; and at least one thread on the neck;

a pump, comprising:

a fitment, comprising:

a pump retention portion;

a body wall extending away from the pump retention portion;

a skirt extending off the bottom of the body wall and toward an interior of the fitment;

at least one opening in the skirt; and at least one thread guide on an interior surface of the body wall;

a pump engine retained by the pump retention portion of the fitment; and a collar overlying the fitment;

wherein the collar secures the pump to the container.

6. The dispenser assembly of claim 5, further comprising a product in the container.

7. The dispenser assembly of claim 5, further comprising a perfume in the container.

8. The dispenser assembly of claim 5, wherein the fitment comprises a fitment made of a plastic material.

9. The dispenser assembly of claim 5, wherein the at least one thread guide further comprises:

a first sloping portion; and a second sloping portion, wherein the first sloping portion and the second sloping portion meet at a peak.

10. A method for assembling and disassembling a dispenser assembly, comprising:

providing a container having a neck and at least one thread on the neck;

providing a pump assembly comprising:

a fitment, comprising:

a pump retention portion;

a skirt extending off a bottom of a body wall and angled toward an interior of the fitment, having at least one opening in the skirt;

the body wall being between the pump retention portion and the skirt;

at least one protrusion on an outer surface of the body wall; and at least one thread guide on an interior surface of the body wall;

a pump engine retained by the pump retention portion of the fitment; and a collar secured to the at least one protrusion;

filling the container with a product;

fitting the pump assembly on a neck of the container, wherein a portion of the pump engine extends into an interior of the container;

forcing the collar over the fitment to secure the pump assembly to the container; and twisting the pump assembly to release the fitment from the neck of the container.

* * * * *